US005614002A

United States Patent [19]

Chen

[11] Patent Number: 5,614,002

[45] Date of Patent: Mar. 25, 1997

[54] HIGH VOLTAGE DUST COLLECTING PANEL

[76] Inventor: Tze L. Chen, P.O. Box 82-144, Taipei, Taiwan

[21] Appl. No.: 547,224

[22] Filed: Oct. 24, 1995

[51] Int. Cl.[6] ..... B03C 3/60

[52] U.S. Cl. ..... 96/55; 96/69; 96/97; 96/98

[58] Field of Search ..... 96/69, 66, 55, 96/57, 97–99, 72, 27, 60, 64; 95/59, 63, 70, 78; 55/523, 524

[56] References Cited

U.S. PATENT DOCUMENTS

| | | | |
|---|---|---|---|
| 2,974,747 | 3/1961 | Coolidge, Jr. et al. | 96/69 |
| 3,273,387 | 3/1966 | Haugen et al. | 96/99 |
| 3,999,964 | 12/1976 | Carr | 96/59 |
| 4,477,268 | 10/1984 | Kalt | 96/99 |
| 4,749,390 | 6/1988 | Burnett et al. | 96/57 |
| 4,772,297 | 9/1988 | Anzai | 96/69 X |
| 4,976,753 | 12/1990 | Huang | 96/99 X |
| 4,978,372 | 12/1990 | Pick | 96/99 X |
| 5,133,788 | 7/1992 | Backus | 96/59 X |
| 5,330,559 | 7/1994 | Cheney et al. | 96/66 X |
| 5,348,571 | 9/1994 | Weber | 55/524 X |

*Primary Examiner*—Richard L. Chiesa
*Attorney, Agent, or Firm*—Alfred Lei

[57] ABSTRACT

In an air purifying apparatus having a housing formed with a recess in which are fitted a static activated carbon panel and a high voltage dust collecting panel, the improvement wherein said high voltage dust collecting panel includes a plurality of cross bars and ventilation slits therebetween, said cross bars being coated with a high conductive and oxidation resistant alloy powder to form anodes and cathodes which are respectively connected to the positive pole and negative pole of a high voltage generating circuit.

2 Claims, 4 Drawing Sheets

PRIOR ART

HIGH VOLTAGE DUST COLLECTING PANEL

BACKGROUND OF THE INVENTION

1. Field of the Invention

This invention relates to a high voltage dust collecting panel which utilizes discharging to collect dust.

2. Description of the Prior Art

The prior art air purifier (see FIGS. 1 and 1A) includes a cover 11, a piece of non-woven cloth 12, and a dust collecting board 13 which are all fitted into a housing 14. A motor-driven fan (not shown) is arranged within the housing 14 for drawing air through the cover 11, the non-woven cloth 12 and the dust collecting board 13. The dust collecting board 13 is provided with a discharging serrated plate 131 and an absorbing plate 132 which are connected with two electrodes of a direct current high voltage power supply. By means of the discharging effect between discharging serrated plate 131 and the absorbing plate 132, the dust particles will carry negative charges and will be attracted by the positive electrode thereby accomplishing the purpose of collecting dust. However, such an air purifier still has the following drawbacks:

1. As the dust collecting board 13 is fixedly mounted within the housing 14 and blocked by the non-woven cloth 12 and the cover 11, it will be inconvenient and difficult for maintenance.
2. Since the cover 11, non-woven cloth 12 and the dust collecting board 13 are separate components, the assembly and manufacturing costs will be increased.
3. As the dust collecting board 13 is fixedly mounted within the housing 14, it is inconvenient to inspect whether the dust collecting board 13 is accumulated with dust or not.

Therefore, it is an object of the present invention to provide an improved dust collecting panel which can obviate and mitigate the above-mentioned drawbacks.

SUMMARY OF THE INVENTION

This invention relates to a high voltage dust collecting panel.

It is the primary object of the present invention to provide a high voltage dust collecting panel which can decrease the volume of a dust collecting apparatus.

It is another object of the present invention to provide a high voltage dust collecting panel which can facilitate the assembly of a dust collecting apparatus.

It is still another object of the present invention to provide a high voltage dust collecting panel which is simple in construction.

It is still another object of the present invention to provide a high voltage dust collecting panel which is easy to manufacture.

It is a further object of the present invention to provide a high voltage dust collecting panel which is low in cost.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figures 1, 1A:
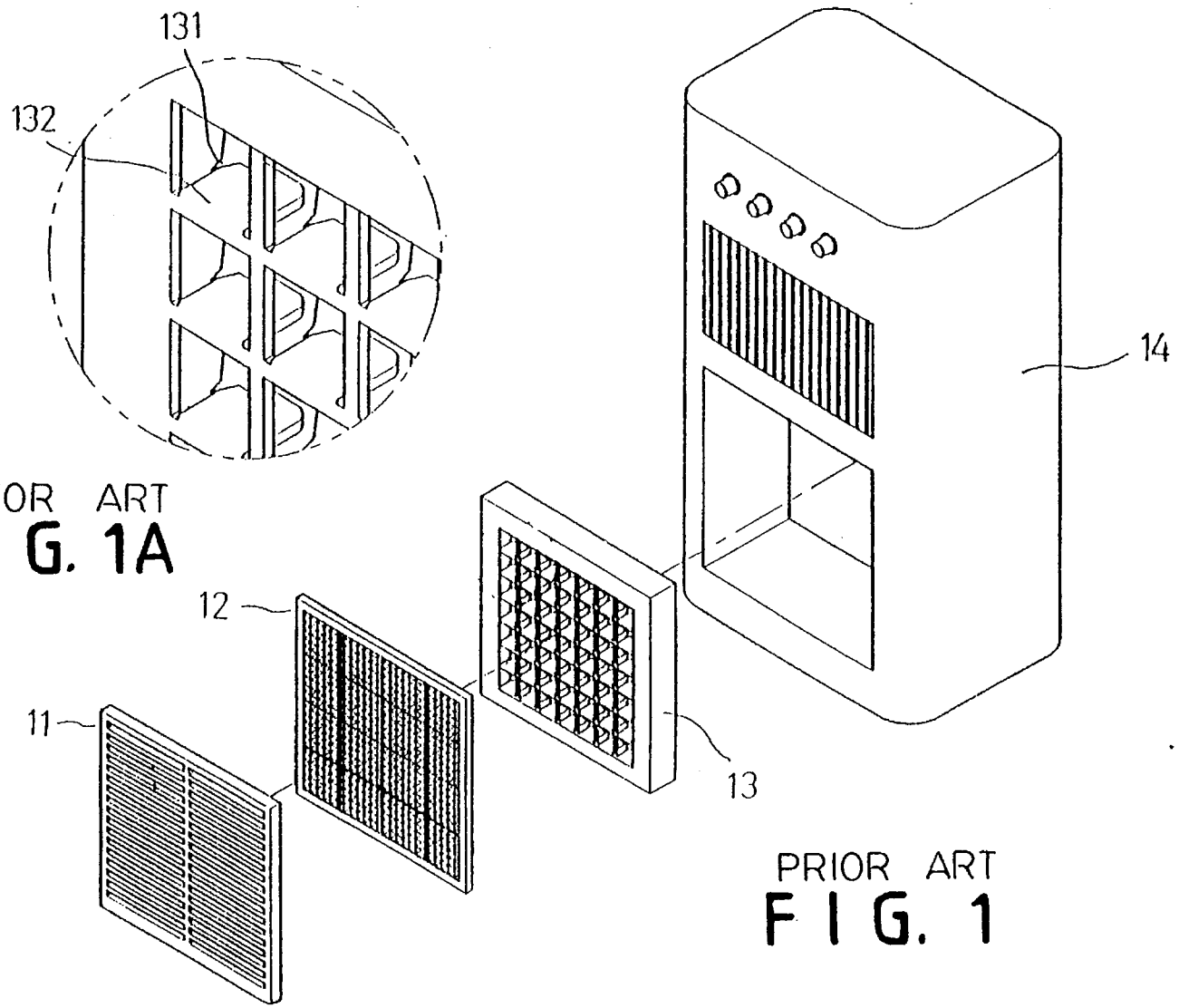
FIG. 1 PRIOR ART
FIG. 1 is an exploded view of a prior art static dust collecting device.
FIG. 1A is an enlarged fragmentary view of FIG. 1.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2A:
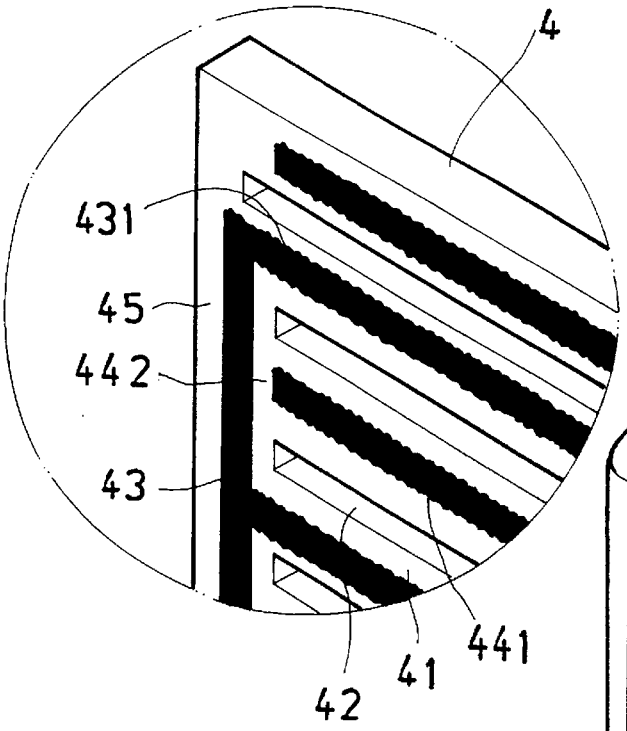
FIG. 2A is an enlarged fragmentary view of FIG. 2.
Figure 2:
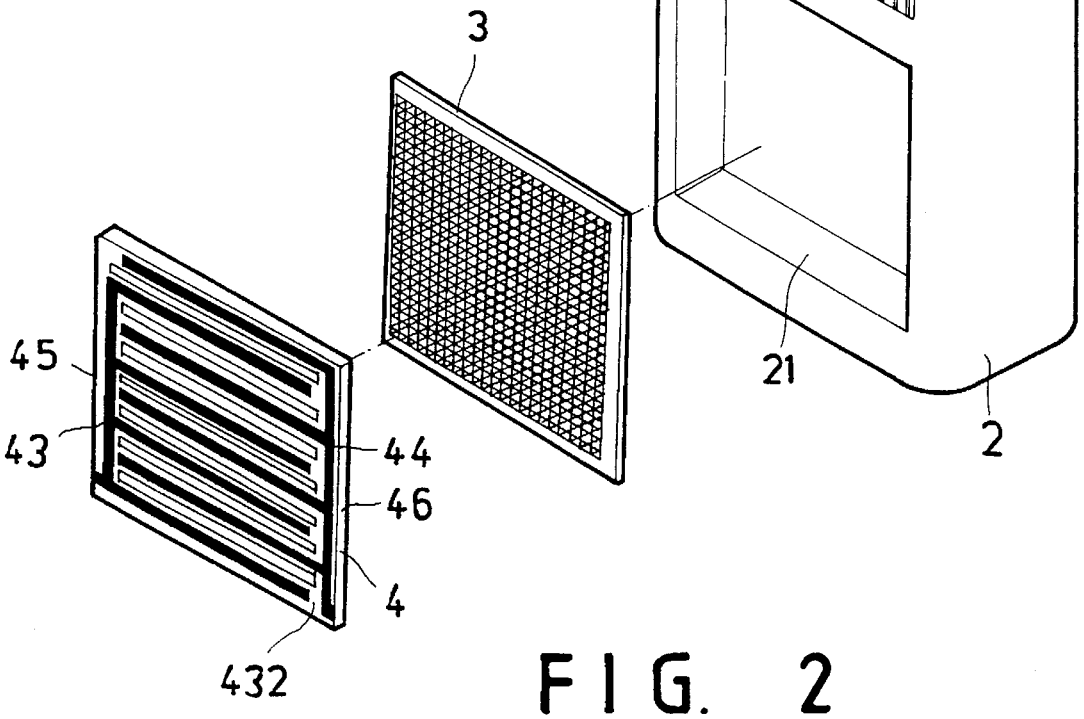
FIG. 2 is an exploded view of the present invention.
Figure 3:
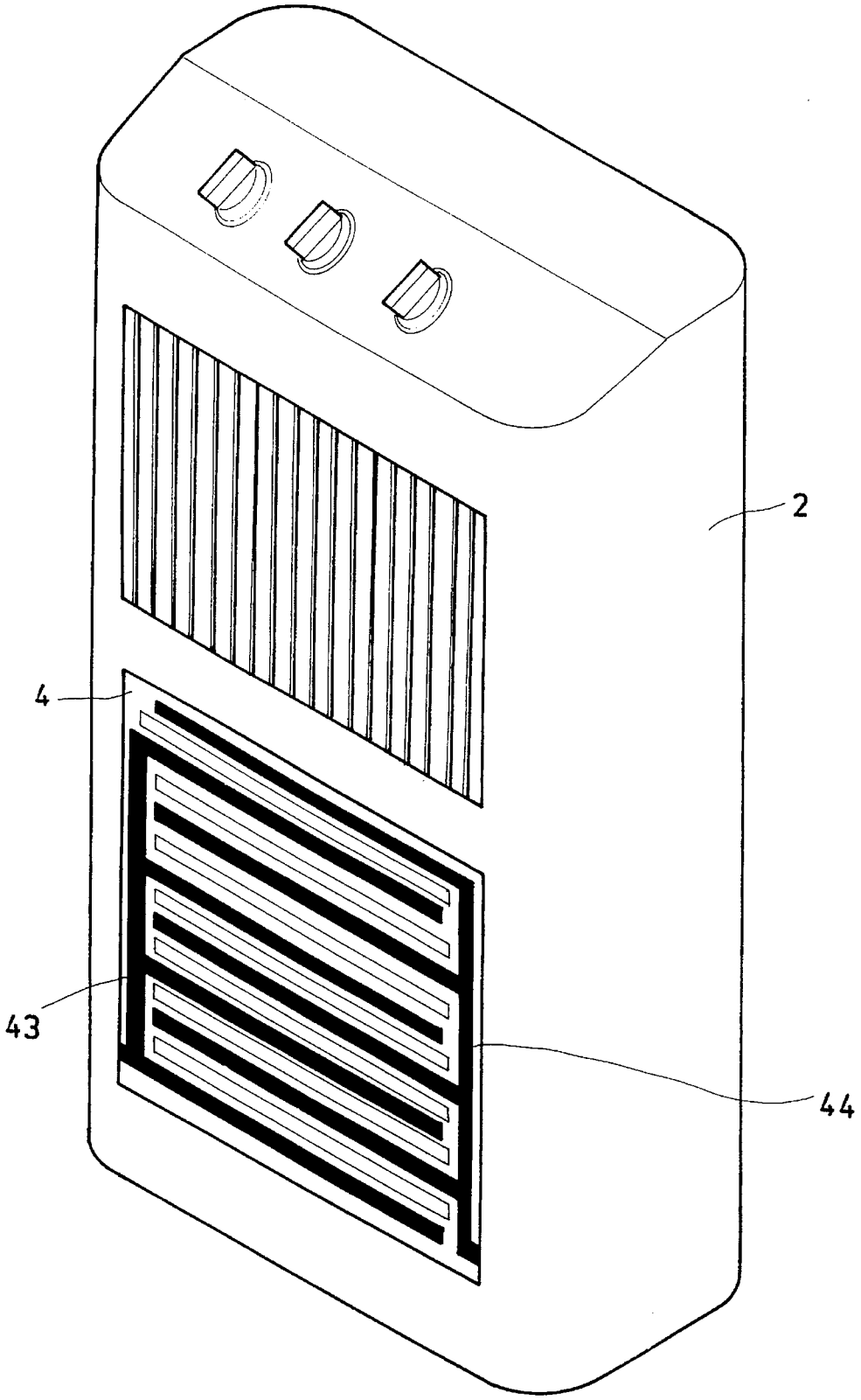
FIG. 3 is a perspective view of the present invention.

With reference to the drawings and in particular to FIGS. 2, 2A and 3 thereof, the dust collecting panel 4 according to the present invention is being used with an air purifier. The air purifier includes a housing 2 having a recess 21 in which are fitted a static activated carbon net 3 and a dust collecting panel 4. The dust collecting panel 4 is a rectangular frame provided with a plurality of horizontal bars 41, a left vertical bar 45, and a right vertical bar 46. Between every two of the horizontal bars 41 there is a slit 42. The horizontal bars 41 and the left and right vertical bars 45 and 46 of the rectangular frame are sprayed or coated with high conductive and oxidation resistant alloy power in a way such that the coating lines 431 on some horizontal bars 41 are connected with the coating line 43 on the left vertical bars 45 to form an anode while the other coating lines 441 on the other horizontal bars 41 with the coating line 44 on the right vertical bar 46 to form a cathode. Further, there is a first gap 442 between the coating line 43 and the coating line 441 and a second gap 432 between the coating line 44 and the coating line 431 so as to prevent short-circuit. The anode and cathode of the dust collecting panel are connected with the positive and negative output terminals of a high voltage generating circuit.

Further, the anodes and cathodes of the high voltage are formed with serrated edges for making them easier to discharge.

Figure 4:
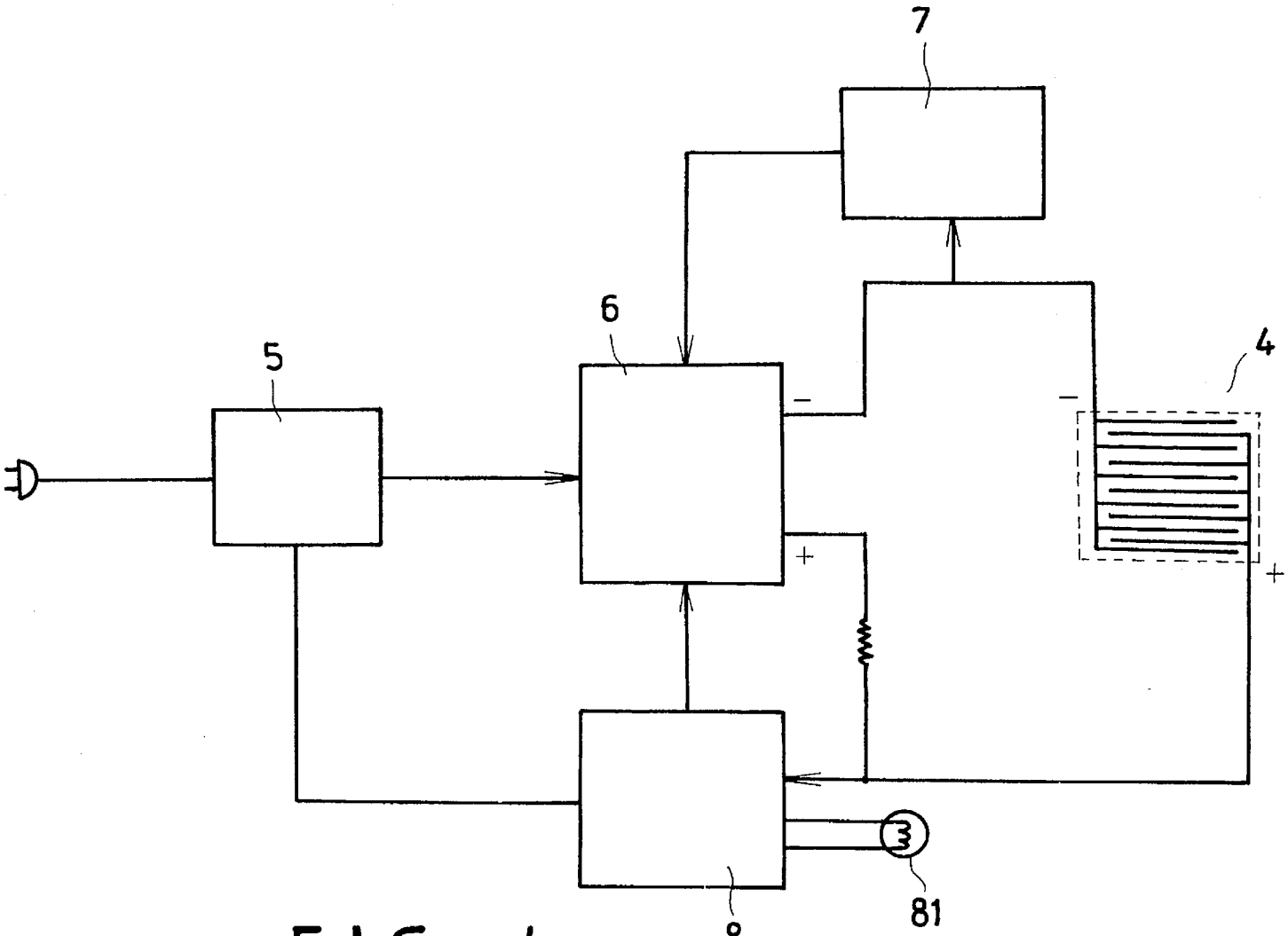
FIG. 4 is a circuit diagram of the present invention.

FIG. 4 is a circuit diagram of the high voltage generating circuit according to the present invention. As illustrated, alternating current is first converted into direct current by a rectifier 5, which is then stepped up by a high voltage generating circuit 6. The high voltage generating circuit 6 is connected with a high voltage stabilizing detecting circuit 7 for stabilizing the output voltage. The high voltage stabilizing detecting circuit 7 is connected with an overcurrent warning circuit 8 which utilizes an indicating light 81 to show whether the circuit is working or not. In case of large dust adhered onto the dust collecting panel according to the present invention, the power supply will be turned off and the indication light will be lit up.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. In an air purifying apparatus having a housing formed with a recess in which are fitted a static activated carbon panel and a high voltage dust collecting panel, the improvement wherein said high voltage dust collecting panel comprises a plurality of cross bars and ventilation slits therebetween, said cross bars being coated with a high conductive and oxidation resistant alloy powder to form anodes and cathodes which are respectively connected to the positive pole and negative pole of a high voltage generating circuit.

2. The air purifying apparatus as claimed in claim 1, wherein said anodes and cathodes are formed with serrated edges, and said static activated carbon panel is arranged behind said high voltage dust collecting panel.

* * * * *